US007465194B1

(12) United States Patent
Ho et al.

(10) Patent No.: US 7,465,194 B1
(45) Date of Patent: Dec. 16, 2008

(54) PLUG CONNECTOR

(75) Inventors: Hsin-Tsung Ho, Taipei Hsien (TW); Shu-Man Chiang, Taipei Hsien (TW); Chung-Hsin Huang, Taipei Hsien (TW); Mei-Chuan Yang, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/965,433

(22) Filed: Dec. 27, 2007

(51) Int. Cl.
*H01R 13/648* (2006.01)

(52) U.S. Cl. ..... 439/607

(58) Field of Classification Search ..... 439/607, 439/610, 660
See application file for complete search history.

(56) References Cited

U.S. PATENT DOCUMENTS 5,273,459 A * 12/1993 Davis ..... 439/607
5,518,421 A * 5/1996 Davis ..... 439/607
6,193,552 B1 * 2/2001 Chiou et al. ..... 439/607
6,659,804 B2 * 12/2003 Nishio et al. ..... 439/660
6,821,151 B2 * 11/2004 Lai ..... 439/610
6,955,568 B1 * 10/2005 Wu ..... 439/660
7,329,154 B2 * 2/2008 Koyama ..... 439/660
7,371,118 B2 * 5/2008 Wu ..... 439/610

* cited by examiner

*Primary Examiner*—Briggitte R Hammond
(74) *Attorney, Agent, or Firm*—WPAT, P.C.; Anthony King

(57) ABSTRACT

A plug connector includes an insulating housing, a plurality of terminals, a rear lid and a cover. The insulating housing has a base portion and a tongue portion extending forward from the base portion and defines a plurality of receiving slots for receiving the respective terminals. Each of the terminals has a soldering section stretching out from the rear of the base portion. The rear lid has a prop section and a support section protruding rearward from the rear of the prop section. The prop section is propped against the rear of the base portion of the insulating housing and defines a plurality of channels passing therethrough. The soldering sections of the terminals pass through the corresponding channels and are supported by the support section to be soldered with cables. The cover wraps the insulating housing and the rear lid.

16 Claims, 5 Drawing Sheets

PLUG CONNECTOR

BACKGROUND OF THE INVENTION

1. Field of the Invention

The present invention relates to a plug connector, and more particularly to a plug connector with terminals capable of being soldered with cables easily.

2. The Related Art

A traditional plug connector includes an upper metal cover, a lower metal cover, an insulating housing, a plurality of terminals and two latches held in the insulating housing. The upper metal cover buckles with the lower metal cover and the two metal covers define a space therebetween. The insulating housing with the terminals and the latches is received in the space. Each of the terminals has a contact section for electrically connecting a mating contact and a soldering section stretching out from the rear of the insulating housing for being soldered with a cable. However, the soldering section stretching out from the rear of the insulating housing is hanged in the air, so the soldering section is difficult to be soldered with the cable.

SUMMARY OF THE INVENTION

It is an object of the present invention to provide a plug connector which can make terminals soldered with cables easily.

The plug connector includes an insulating housing, a plurality of terminals, a rear lid and a cover. The insulating housing has a base portion and a tongue portion extending forward from the base portion and defines a plurality of receiving slots for receiving the respective terminals. Each of the terminals has a soldering section stretching out from the rear of base portion. The rear lid has a prop section and a support section protruding rearward from the rear of the prop section. The prop section is propped against the rear of the base portion of the insulating housing and defines a plurality of channels passing therethrough. The soldering sections of the terminals pass through the corresponding channels and are supported by the support section. The cover wraps the insulating housing and the rear lid.

As described above, the soldering sections of the terminals pass through the corresponding channels of the rear lid to abut against the support section of the rear lid and are separated by the support section of the rear lid, therefore, the soldering sections of the terminals can be soldered with the cables easily.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
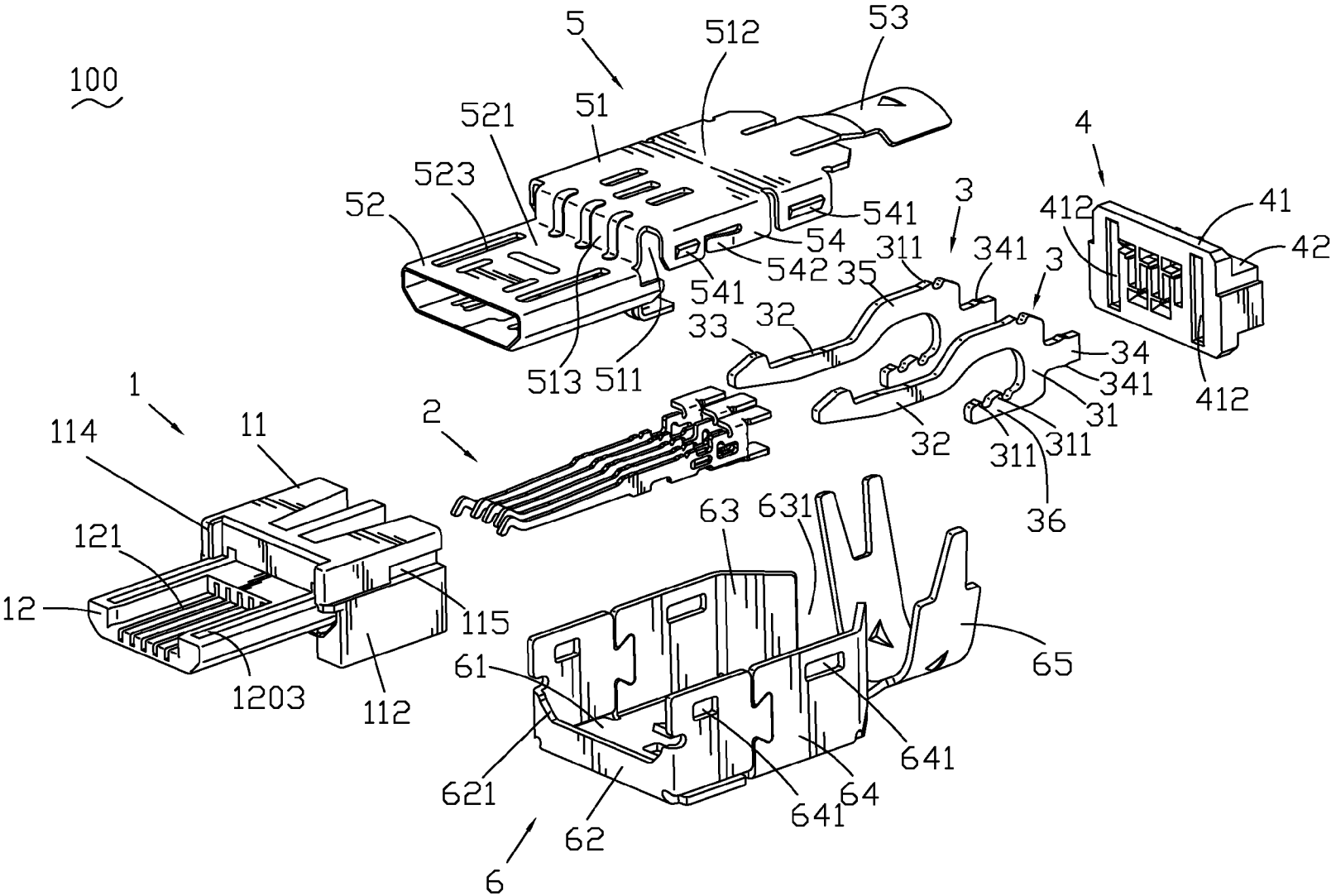
FIG. 1 is an exploded perspective view of a plug connector in accordance with the present invention.

Referring to FIG. 1, a plug connector 100 according to the present invention includes an insulating housing 1, a plurality of terminals 2, a pair of latches 3, a rear lid 4, an upper metal cover 5 and a lower metal cover 6.

Figure 2:
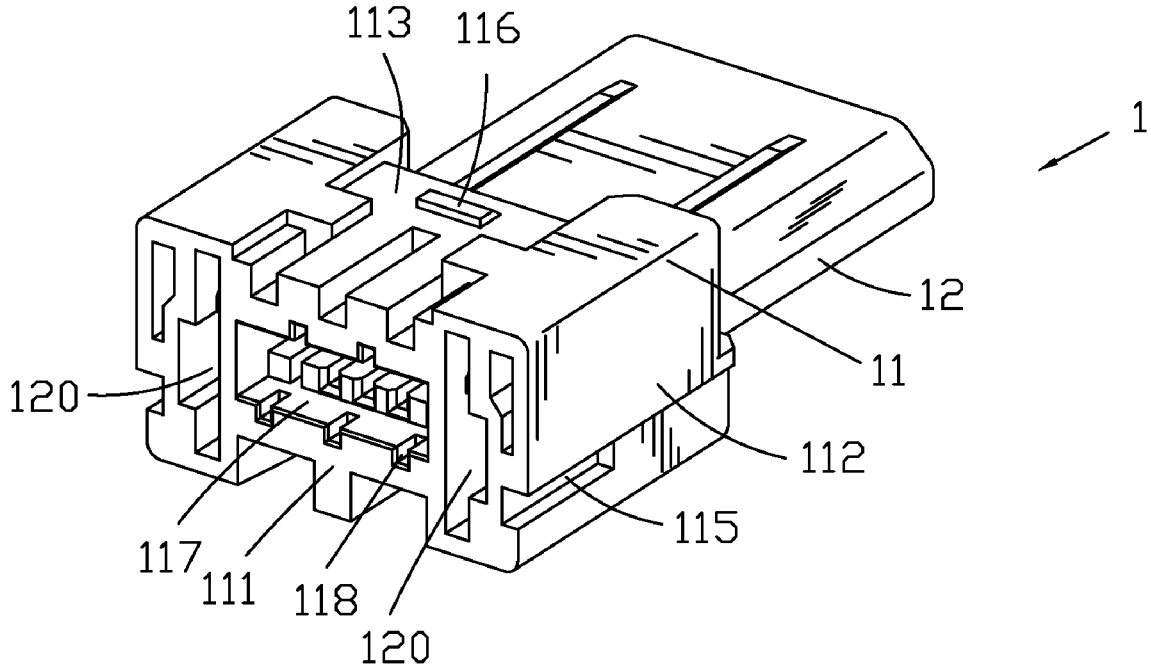
FIG. 2 is a perspective view of an insulating housing of the plug connector.
Figure 3:
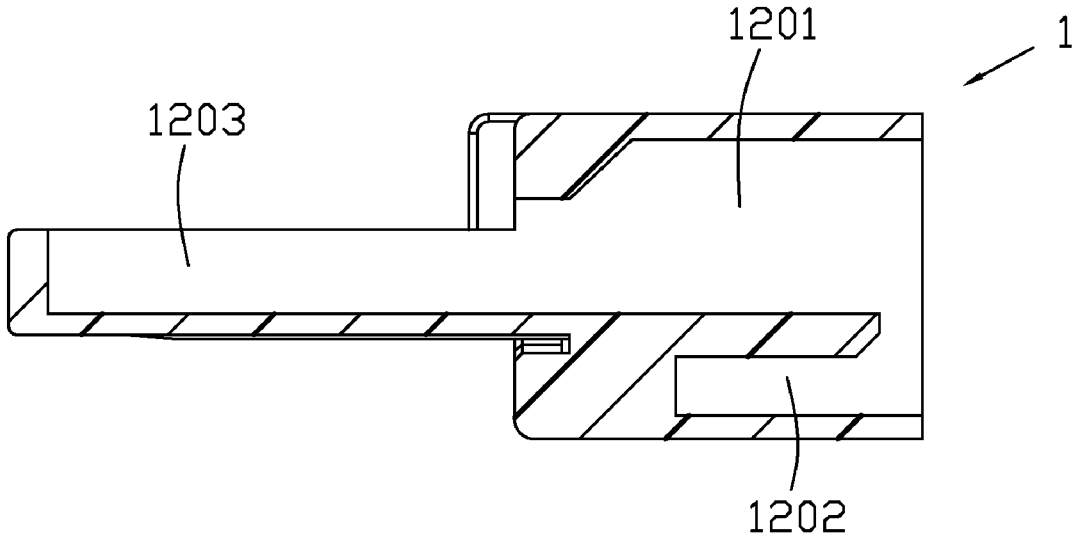
FIG. 3 is a cross-sectional view of the insulating housing of FIG. 2.

Referring to FIGS. 1-3, the insulating housing 1 has a base portion 11 and a tongue portion 12 which is formed by the base portion 11 stretching forward from the middle thereof. The base portion 11 has a rear wall 111, two sidewalls 112 and a bottom wall 113. Each of the sidewalls 112 protrudes forward to form a fixing projection 114 above the tongue portion 12. The rear of the sidewall 112 defines a preventing recess 115. The middle of the bottom wall 113 protrudes downward to form a locking projection 116. The middle of the rear wall 111 is concaved inward to form an opening 117. The top of the tongue portion 12 defines a plurality of receiving slots 121 extending rearward into the base portion 11 to communicate with the opening 117. The top and the bottom of the opening 117 respectively define a plurality of fixing gaps 118 arranged alternately and corresponding to the respective receiving slots 121. The rear wall 111 defines two cavities 120 adjacent to two sides of the opening 117 respectively. Each of the cavities 120 includes an upper cavity 1201 and a lower cavity 1202. The upper cavity 1201 extends forward to the front of the tongue portion 12 to define a front cavity 1203 penetrating the top of the tongue portion 12. The lower cavity 1202 extends forward to the middle of the base portion 11, the lower cavity 1202 and the upper cavity 1201 connect with each other at the rear thereof.

Figure 4:
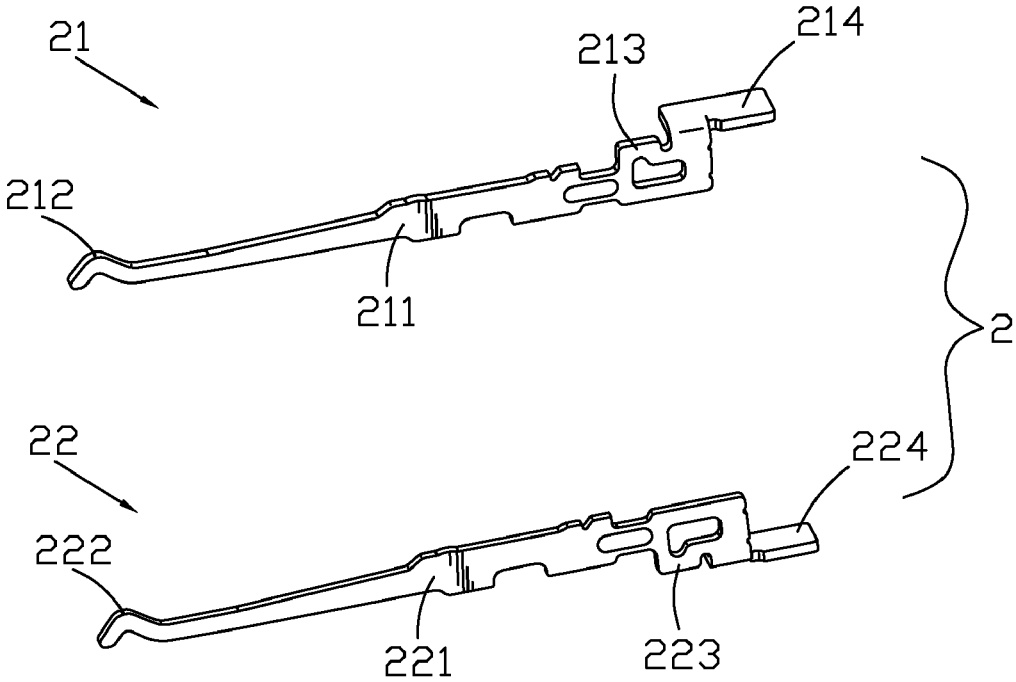
FIG. 4 is a perspective view of a first terminal and a second terminal of the plug connector.

Referring to FIGS. 1 and 4, the terminals 2 include a plurality of first terminals 21 and a plurality of second terminals 22 arranged alternately in the insulating housing 1. The first terminal 21 and the second terminal 22 respectively have a fixing section 211, 221 extending longitudinally. The front of the fixing section 211, 221 protrudes upward to form a contact section 212, 222. The top of the rear of the fixing section 211 of the first terminal 21 extends sideward and then rearward to form a first soldering section 214 of flat shape. A first protrusion 213 protrudes upward from the fixing section 211 and is adjacent to the front of the first soldering section 214. The bottom of the rear of the fixing section 221 of the second terminal 22 extends sideward and then rearward to form a second soldering section 224 of flat shape. A second protrusion 223 protrudes upward from the fixing section 221 and is adjacent to the front of the first soldering section 224.

Referring to FIG. 1, each of the latches 3 has a vertical inserting portion 31. The top of the inserting portion 31 extends forward to form a first fixing portion 35. The front of the first fixing portion 35 inclines downward and then extends forward to form an elastic portion 32. A front end of the elastic portion 32 protrudes upward to form a hook 33. The bottom of the inserting portion 31 extends forward to form a second fixing portion 36. The top of the first fixing portion 35 and the top of the second fixing portion 36 respectively define a plurality of lumps 311. The middle of the rear of the inserting portion 31 extends rearward to form a holding portion 34. The top and the bottom of the holding portion 34 respectively define a bump 341.

Figure 5:
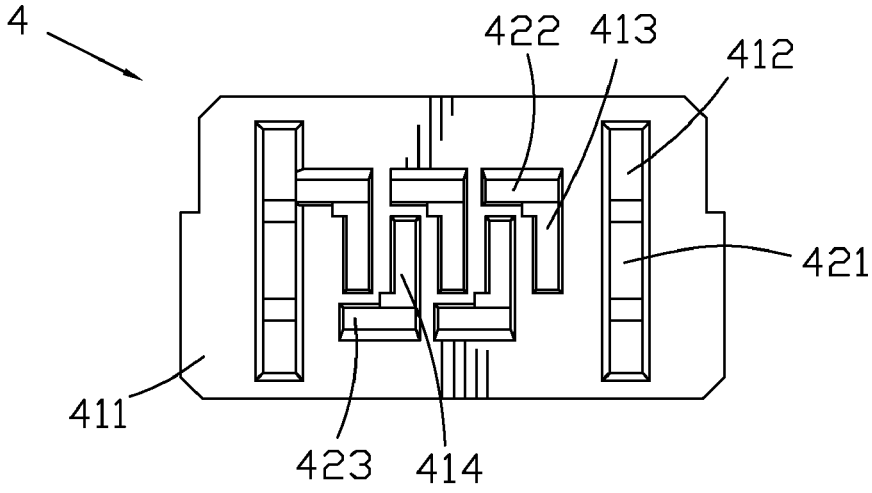
FIG. 5 is a front view of a rear lid of the plug connector.
Figure 8:
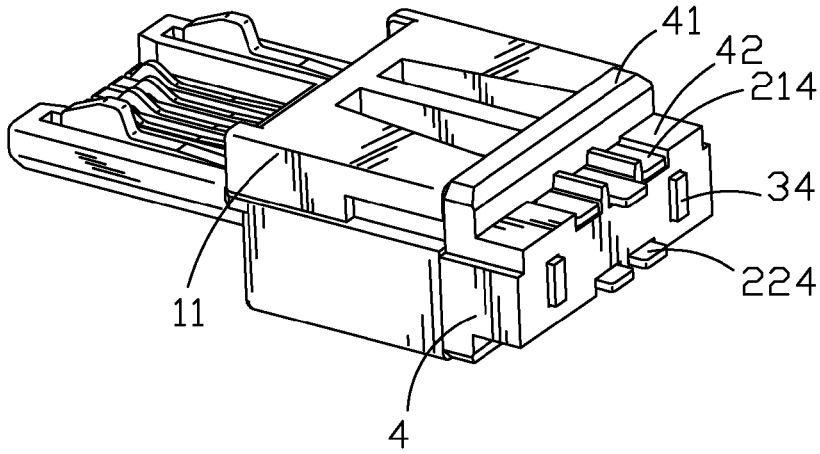
FIG. 8 is a perspective view of the plug connector without the upper metal cover and a lower metal cover.

Referring to FIGS. 1, 5 and 8, the rear lid 4 has a prop section 41 and a support section 42 protruding rearward from the middle of the rear of the prop section 41. The prop section 41 has a front surface 411. Two sides of the front surface 411 respectively define a first fillister 412 in accordance with the corresponding cavity 120 of the insulating housing 1. The middle of the rear of the first fillister 412 extends rearward to pass through the support section 42 for defining a second fillister 421 for receiving the holding portion 34 of the corresponding latch 3. The middle of the front surface 411 of the prop section 41 vertically defines a plurality of first fixing slots 413 and a plurality of second fixing slots 414 arranged alternately. The top of the first fixing slot 413 extends sideward and then rearward to pass through the support section 42 for defining a first channel 422, the first channel 422 is exposed to the top of the support section 42 and is used to receive the corresponding first soldering section 214 of the first terminal 21. The bottom of the second fixing slot 414 extends sideward and then rearward to pass through the support section 42 for defining a second channel 423, the second channel 423 is exposed to the bottom of the support section 42 and is used to receive the corresponding second soldering section 224 of the second terminal 22.

Figure 6:
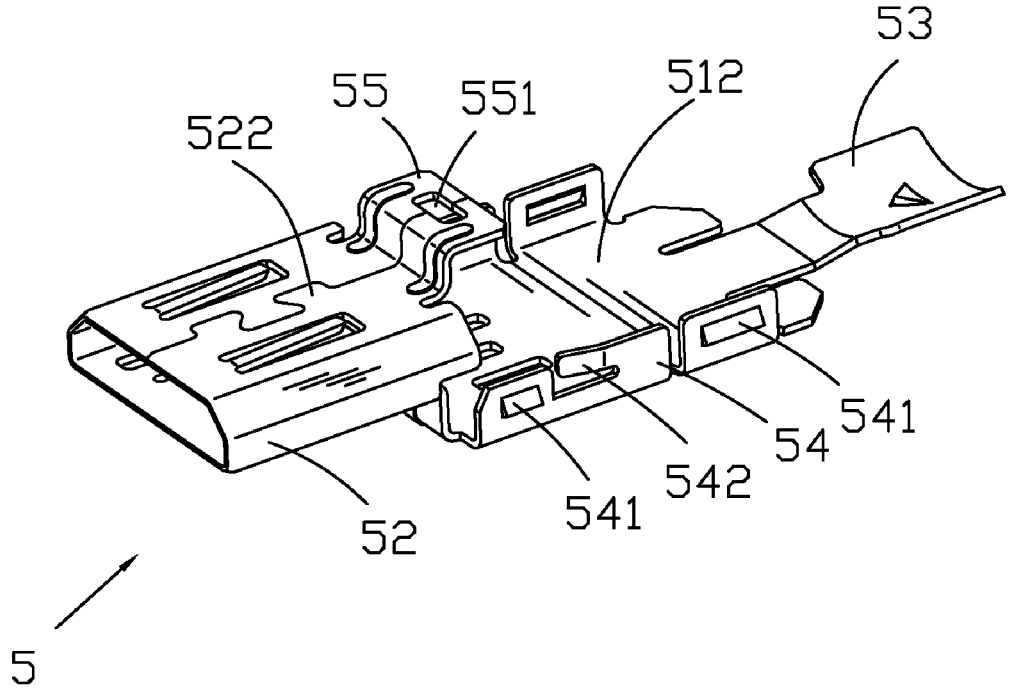
FIG. 6 is a perspective view of an upper metal cover of the plug connector.

Referring to FIGS. 1 and 6, the upper metal cover 5 has a hollow front cover 52 and a rear cover 51 at the rear of the front cover 52. The front cover 52 has a top plate 521 and a bottom plate 522. Two sides of the top plate 521 respectively define a holding slot 523 extending longitudinally. The middle of the rear of the bottom plate 522 bends downward and then extends rearward to form a locking plate 55. The locking plate 55 defines a locking hole 551 corresponding to the locking projection 116 of the insulating housing 1. The rear of the top plate 521 bends upward to form a connecting section 513. The rear cover 51 has a top board 512 connected to the top of the connecting section 513 and two side plates 54 bending downward from two opposite sides of the top board 512 respectively. Each of the side plates 54 protrudes outward to form two locking blocks 541. The side plate 54 defines a locking arm 542 having a rear end connected to the side plate 54 and a front end inclining inward freely. Two sides of the connecting section 513 respectively open a fixing recess 511. The middle of the top board 512 of the rear cover 51 extends rearward to form a fastening section 53.

Referring to FIG. 1, the lower metal cover 6 includes a basic plank 61, a front plank 62, a rear plank 63 and two side planks 64. The front plank 62 defines a front mouth 621 at the top thereof, and the rear plank 63 defines a rear mouth 631 at the middle thereof. Each side plank 64 opens two apertures 641 in accordance with the corresponding locking blocks 541 of the upper metal cover 5. The middle of the rear of the basic plank 61 extends rearward to form a retention section 65.

Figure 7:
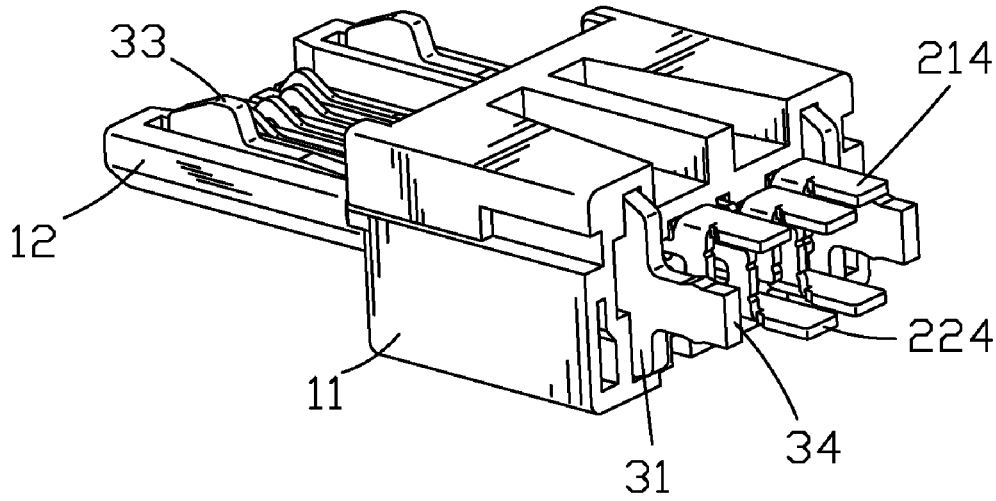
FIG. 7 is an assembled view of the insulating housing, the terminals and a pair of latches of the plug connector.
Figure 9:
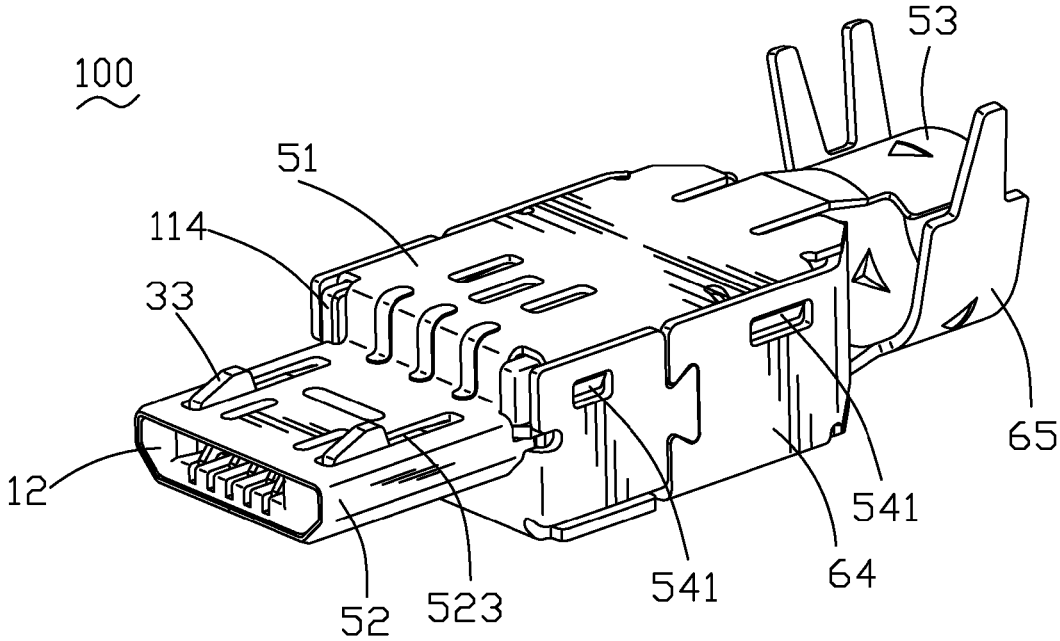
FIG. 9 is a perspective view of the plug connector.

Referring to FIGS. 7-9, in assembly, the terminals 2 are received in the insulating housing 1. The fixing sections 211, 221 and the contact sections 212, 222 of the terminals 2 are held in the corresponding receiving slots 121 of the tongue portion 12. The first protrusion 213 of the first terminal 21 and the second protrusion 223 of the second terminal 22 respectively are inserted in the corresponding fixing gaps 118 of the base portion 11. The first soldering section 214 and the second soldering section 224 stretch out from the rear wall 111 of the base portion 11. The latch 3 is held in the corresponding cavity 120 of the insulating housing 1. The first fixing portion 35 of the latch 3 is received in the upper cavity 1201 of the cavity 120 and the second fixing portion 36 is received in the lower cavity 1202. The lumps 311 abut against inner walls of the cavity 120. The elastic portion 32 is received in the front cavity 1203 and the hook 33 protrudes out from the top of the front cavity 1203. The holding portion 34 and the rear of the inserting portion 31 stretch out from the rear wall 111 of the base portion 11.

When the rear lid 4 and the insulating housing 1 with the terminals 2 and the latches 3 are assembled, the front surface 411 of the prop section 41 of the rear lid 4 is propped against the rear wall 111 of the base portion 11 of the insulating housing 1. The rear of the inserting portion 31 of the latch 3 is received in the corresponding first fillister 412 of the rear lid 4. The holding portion 34 is inserted in the second fillister 421 and the bumps 341 abut against the inner wall of the second fillister 421. Therefore, the rear lid 4 is assembled with the insulating housing 1 firmly and prevents the terminals 2 moving rearward. The rear of the fixing section 211 of the first terminal 21 is held in the first fixing slot 413 and the rear of the fixing section 221 of the second terminal 22 is held in the second fixing slot 414. Accordingly, the first soldering section 214 of the first terminal 21 is inserted in the corresponding first channel 422 and the second soldering section 224 of the second terminal 22 is inserted in the corresponding second channel 423. After the rear lid 4 is assembled with the insulating housing 1, the soldering sections 214, 224 of the terminals 2 are soldered with cables (not shown).

The upper metal cover 5 buckles with the lower metal cover 6 and the front cover 52 of the upper metal cover 5 stretches out from the front mouth 621 of the lower metal cover 6. The rear cover 51 of the upper metal cover 5 and the lower metal cover 6 define a space therebetween and the base portion 11 of the insulating housing 1 and the rear lid 4 are received in the space. The tongue portion 12 of the insulating housing 1 is inserted in the front cover 52 of the upper metal cover 5. The hook 33 of the latch 3 is located in the holding slot 523 of the front cover 52 and protrudes out from the holding slot 523. The fixing projection 114 of the insulating housing 1 is inserted in the corresponding fixing recess 511 of the upper metal cover 5. The locking arm 542 of the side plate 54 buckles into the corresponding preventing recess 115 of the base portion 11 to prevent the insulating housing 1 moving rearward. The locking plate 55 is against the bottom wall 113 of the base portion 11 and the locking projection 116 buckles into the locking hole 551 to fix the insulating housing 1. The locking blocks 541 of the upper metal cover 5 buckle into the corresponding apertures 641 of the lower metal cover 6 to fix the lower metal cover 6 and the upper metal cover 5 together. The cables soldered to the soldering sections 214, 224 of the terminals 2 pass through the rear mouth 631 of the lower metal cover 6 and are fastened by the fastening section 53 and the retention section 65.

As described above, the rear lid 4 is propped against the insulating housing 1 firmly by the latches 3 mating with the corresponding first fillister 412 and the second fillister 421, which do not need extra elements to fix the rear lid 4 to the insulating housing 1. In addition, the rear lid 4 can prevent the terminals 2 moving rearward. The soldering sections 214, 224 of the terminals 2 are held in the channels 422, 423 of the rear lid 4 steadily and are separated by the support section 42 of the rear lid 4, therefore, the soldering sections 214, 224 of the terminals 2 can be soldered with the cables easily.

What is claimed is:

1. A plug connector comprising:

an insulating housing having a base portion and a tongue portion extending forward from the base portion, a plurality of receiving slots being defined in the base portion and the tongue portion;

a plurality of terminals received in the respective receiving slots of the insulating housing, each of the terminals having a soldering section stretching out from the rear of the base portion;

a rear lid having a prop section and a support section protruding rearward from the rear of the prop section, the prop section being propped against the rear of the base portion and defining a plurality of channels passing therethrough, the soldering sections of the terminals passing through the corresponding channels and supported by the support section;

a cover wrapping the insulating housing and the rear lid;

wherein the terminal has a fixing section extending longitudinally, the soldering section connects the rear of the fixing portion and is flat;

wherein the fixing section protrudes to form a protrusion adjacent to the front of the soldering section; and wherein the rear of the base portion is concaved inward to form an opening communicating with the receiving slots and defines a plurality of fixing gaps communicating with the opening and corresponding to the respective receiving slots for locking the protrusion therein.

2. The plug connector as claimed in claim 1, wherein the terminals include a plurality of first terminals and a plurality of second terminals arranged alternately, the soldering section of the first terminal is formed by extending sideward and then rearward from the top of the fixing section, the soldering section of the second terminal is formed by extending sideward and then rearward from the bottom of the fixing section, the soldering sections of the first terminal and the second terminal are respectively supported by the top and the bottom of the support section.

3. The plug connector as claimed in claim 2, wherein the prop section of the rear lid defines a plurality of first fixing slots and a plurality of second fixing slots arranged alternately, the channels include a plurality of first channels and a plurality of second channels, the first channel extends sideward and then rearward from the top of the first fixing slot, the second channel extends sideward and then rearward from the bottom of the second fixing slot, the rear of the fixing section of the first terminal is received in the corresponding first fixing slot, and the rear of the fixing section of the second terminal is received in the corresponding second fixing slot.

4. The plug connector as claimed in claim 3, wherein the first channel extends through the support section and is exposed to the top of the support section, the second channel extends through the support section and is exposed to the bottom of the support section, the soldering sections of the first terminal and the second terminal are respectively held in the corresponding first and second channels.

5. The plug connector as claimed in claim 1, further comprising two latches respectively received in the insulating housing, each of the latches has a vertical inserting portion and a holding portion protruding rearward from the rear of the inserting portion, the rear of the inserting portion and the holding portion stretch out from the rear of the base portion of the insulating housing, the prop section of the rear lid defines two first fillisters, the rear of the first fillister extends rearward and is narrowed to form a second fillister, the rear of the inserting portion of the latch is received in the corresponding first fillister of the rear lid, and the holding portion is inserted in the corresponding second fillister of the rear lid.

6. The plug connector as claimed in claim 5, wherein the top and the bottom of the holding portion of the latch respectively define a bump abutting against inner walls of the corresponding second fillister of the rear lid.

7. A plug connector comprising:

an insulating housing having a base portion and a tongue portion extending forward from the base portion, a plurality of receiving slots being defined in the base portion and the tongue portion;

a plurality of terminals received in the respective receiving slots of the insulating housing, each of the terminals having a soldering section stretching out from the rear of the base portion;

a rear lid having a prop section and a support section protruding rearward from the rear of the prop section, the prop section being propped against the rear of the base portion and defining a plurality of channels passing therethrough, the soldering sections of the terminals passing through the corresponding channels and supported by the support section;

a cover wrapping the insulating housing and the rear lid;

wherein the terminal has a fixing section extending longitudinally, the soldering section connects the rear of the fixing portion and is flat; and wherein the terminal include a plurality of first terminals and a plurality of second terminals arranged alternately, the soldering section of the first terminal is formed by extending sideward and then rearward from the top of the fixing section, the soldering section of the second terminal is formed by extending sideward and then rearward from the bottom of the fixing section, the soldering sections of the first terminal and the second terminal are respectively supported by the top and the bottom of the support section.

8. The plug connector as claimed in claim 7, wherein the fixing section protrudes to form a protrusion adjacent to the front of the soldering section.

9. The plug connector as claimed in claim 7, wherein the prop section of the rear lid defines a plurality of first fixing slots and a plurality of second fixing slots arranged alternately, the channels include a plurality of first channels and a plurality of second channels, the first channel extends sideward and then rearward from the top of the first fixing slot, the second channel extends sideward and then rearward from the bottom of the second fixing slot, the rear of the fixing section of the first terminal is received in the corresponding first fixing slot, and the rear of the fixing section of the second terminal is received in the corresponding second fixing slot.

10. The plug connector as claimed in claim 9, wherein the first channel extends through the support section and is exposed to the top of the support section, the second channel extends through the support section and is exposed to the bottom of the support section, the soldering sections of the first terminal and the second terminal are respectively held in the corresponding first and second channels.

11. The plug connector as claimed in claim 7, further comprising two latches respectively received in the insulating housing, each of the latches has a vertical inserting portion and a holding portion protruding rearward from the rear of the inserting portion, the rear of the inserting portion and the holding portion stretch out from the rear of the base portion of the insulating housing, the prop section of the rear lid defines two first fillisters, the rear of the first fillister extends rearward and is narrowed to form a second fillister, the rear of the inserting portion of the latch is received in the corresponding first fillister of the rear lid, and the holding portion is inserted in the corresponding second fillister of the rear lid.

12. The plug connector as claimed in claim 11, wherein the top and the bottom of the holding portion of the latch respectively define a bump abutting against inner walls of the corresponding second fillister of the rear lid.

13. A plug connector comprising:

an insulating housing having a base portion and a tongue portion extending forward from the base portion, a plurality of receiving slots being defined in the base portion and the tongue portion;

a plurality of terminals received in the respective receiving slots of the insulating housing, each of the terminals having a soldering section stretching out from the rear of the base portion;

a rear lid having a prop section and a support section protruding rearward from the rear of the prop section, the prop section being propped against the rear of the base portion and defining a plurality of channels passing therethrough, the soldering sections of the terminals passing through the corresponding channels and supported by the support section;

a cover wrapping the insulating housing and the rear lid; and wherein the plug connector further comprising two latches respectively received in the insulating housing, each of the latches has a vertical inserting portion and a holding portion protruding rearward from the rear of the inserting portion, the rear of the inserting portion and the holding portion stretch out from the rear of the base portion of the insulating housing, the prop section of the rear lid defines two first fillisters, the rear of the first fillister extends rearward and is narrowed to form a second fillister, the rear of the inserting portion of the latch is received in the corresponding first fillister of the rear lid, and the holding portion is inserted in the corresponding second fillister of the rear lid.

14. The plug connector as claimed in claim 13, wherein the top and the bottom of the holding portion of the latch respectively define a bump abutting against inner walls of the corresponding second fillister of the rear lid.

15. The plug connector as claimed in claim 13, wherein the terminal has a fixing section extending longitudinally, the soldering section connects the rear of the fixing portion and is flat.

16. The plug connector as claimed in claim 15, wherein the fixing section protrudes to form a protrusion adjacent to the front of the soldering section.

* * * * *